US008128423B2

(12) United States Patent
Borgstrom et al.

(10) Patent No.: US 8,128,423 B2
(45) Date of Patent: Mar. 6, 2012

(54) VISIBLE OPEN FOR SWITCHGEAR ASSEMBLY

(75) Inventors: Alan D. Borgstrom, Hackettstown, NJ (US); James Cole, Oxford, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/190,580

(22) Filed: Jul. 26, 2011

(65) Prior Publication Data

US 2012/0028510 A1 Feb. 2, 2012

Related U.S. Application Data

(60) Provisional application No. 61/368,758, filed on Jul. 29, 2010.

(51) Int. Cl.
*H01R 13/53* (2006.01)

(52) U.S. Cl. ..... 439/181

(58) Field of Classification Search ..... 439/181, 439/184, 183, 185, 921, 205
See application file for complete search history.

(56) References Cited

U.S. PATENT DOCUMENTS

| | | | | |
|---|---|---|---|---|
| 4,891,016 | A * | 1/1990 | Luzzi et al. | 439/183 |
| 7,503,785 | B2 * | 3/2009 | Stepniak | 439/187 |
| 7,520,773 | B2 * | 4/2009 | Siebens et al. | 439/488 |
| 7,648,376 | B1 * | 1/2010 | Borgstrom | 439/181 |
| 2010/0022111 | A1 * | 1/2010 | Borgstrom | 439/187 |
| 2011/0189887 | A1 * | 8/2011 | Borgstrom et al. | 439/488 |

* cited by examiner

*Primary Examiner* — Tulsidas C Patel
*Assistant Examiner* — Phuongchi Nguyen
(74) *Attorney, Agent, or Firm* — Snyder, Clark, Lesch & Chung, LLP

(57) ABSTRACT

An electrical connector assembly may include a connector body having a conductor receiving end, a connector end, a linking assembly connecting the conductor receiving end to the connector end, and a visible open port positioned in the connector body for viewing at least a portion of the linking assembly. The linking assembly may include a rearward conductive end conductively coupled to the conductor receiving end, a flexible conductor conductively coupled to the connector end, and a linking pin coupled to the flexible conductor and movable between a first position and a second position. The first position maintains the conductor receiving end electrically isolated from the connector end, and the second position conductively couples the conductor receiving end to the connector end.

18 Claims, 2 Drawing Sheets

VISIBLE OPEN FOR SWITCHGEAR ASSEMBLY

CROSS-REFERENCE TO RELATED APPLICATION

This application claims priority under 35. U.S.C. §119, based on U.S. Provisional Patent Application No. 61/368,758 filed Jul. 29, 2010, the disclosure of which is hereby incorporated by reference herein.

BACKGROUND OF THE INVENTION

The present invention relates to electrical cable connectors, such as loadbreak connectors and deadbreak connectors. More particularly, aspects described herein relate to an electrical cable connector, such as a power cable elbow or T-connector connected to electrical switchgear assembly.

High and medium voltage switch assemblies may include sub-atmospheric or vacuum type circuit interrupters, switches, or circuit breakers for use in electric power circuits and systems. Insulated vacuum bottles switches in such systems typically do not provide means for visual inspection of the contacts to confirm whether they are open (visible break) or closed. Non-vacuum bottle type switches previously used were designed to include contacts in a large gas or oil filled cabinet that allowed a glass window to be installed for viewing the contacts. However, with vacuum type switches, there is typically provided no means of directly viewing contacts in the vacuum bottles since the bottles are made of metal and ceramic non-transparent materials.

Typically, conventional insulated switches using vacuum technology are sealed inside the vacuum bottle and hidden from view. The voltage source and the load are connected to the switch, but the switch contacts are not visible. The only means for determining the status of the switch contacts is the position of a switch handle associated with the switch. If the linkage between the handle and the switch contacts is inoperative or defective, there is no positive indication that allows the operating personnel to accurately determine the position of the contacts. This can result in false readings, which can be very dangerous to anyone operating the switch or working on the lines/equipment.

DETAILED DESCRIPTION OF THE PREFERRED EMBODIMENTS

The following detailed description refers to the accompanying drawings. The same reference numbers in different drawings may identify the same or similar elements.

Figures 1A, 1B:
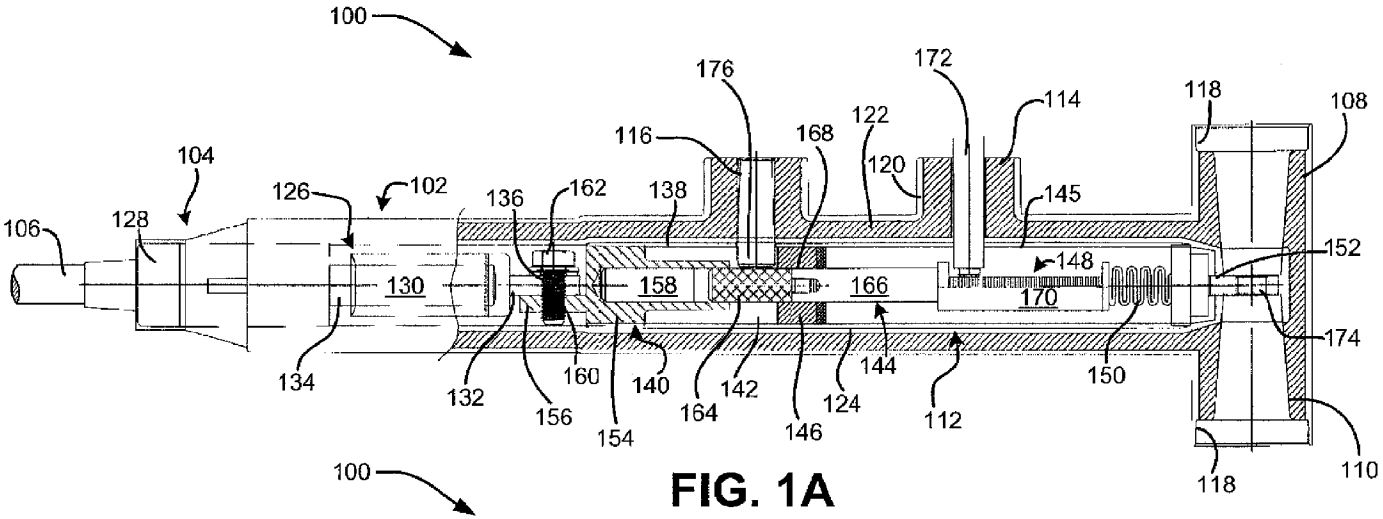
FIG. 1A is a schematic cross-sectional diagram illustrating an electrical connector consistent with implementations described herein in a de-energized state.
FIG. 1B is a top view diagram of the electrical connector of FIG. 1A in the de-energized state.

FIGS. 1A and 1B are a schematic cross-sectional diagram and top view, respectively, illustrating a power cable elbow connector 100 configured in a manner consistent with implementations described herein in a de-energized state. As shown in FIG. 1A, power cable elbow connector 100 may include a body portion 102, a conductor receiving end 104 for receiving a power cable 106 therein, first and second T ends 108/110 distal from conductor receiving end 104 and that include openings for receiving a deadbreak transformer bushing or other high or medium voltage terminal, such as an insulating plug, or other power equipment (e.g., a tap, a grounding device, a voltage arrestor, a bushing, etc.), a visible open linking assembly 112, a link access opening 114, and a visible open port 116.

First T end 108 and second T end 110 may include a flange or elbow cuff 118 surrounding the open receiving end thereof. Body portion 102 may extend substantially axially and may include a bore extending therethrough. First and second T ends 108/110, link access opening 114, and visible open port 116 may project substantially perpendicularly from body portion 102, as illustrated in FIG. 1A.

Power cable elbow connector 100 may include an electrically conductive outer shield 120 formed from, for example, a conductive or semi-conductive peroxide-cured synthetic rubber, such as EPDM (ethylene-propylene-dienemonomer). Within shield 120, power cable elbow connector 100 may include an insulative inner housing 122, typically molded from an insulative rubber or epoxy material. Within insulative inner housing 122, power cable elbow connector 100 may include a conductive or semi-conductive insert 124 that surrounds the connection portion of power cable 106 and visible open linking assembly 112.

Conductor receiving end 104 of power cable elbow connector 100 may be configured to receive power cable 106 therein. As shown in FIG. 1A, a forward end of power cable 106 may be prepared by connecting power cable 106 to a conductor spade assembly 126. Conductor spade assembly 126 may include a modular configuration that includes a rearward sealing portion 128, a crimp connector portion 130, and a spade portion 132.

Rearward sealing portion 128 may include an insulative material surrounding a portion of power cable 106 about an opening of conductor receiving end 104. When conductor spade assembly 126 is positioned within conductor receiving end 104 (e.g., within insert 124), rearward sealing portion 128 may seal an opening of conductor receiving end 104 about power cable 106.

Crimp connector portion 130 may include a substantially cylindrical assembly configured to receive a center conductor 134 of power cable 106 therein. Upon insertion of center conductor 134 therein, crimp connector portion 130 may be crimped onto or otherwise secured to center conductor 134 prior to insertion of power cable 106 into conductor receiving end 104.

Spade portion 132 may be conductively coupled to crimp connector portion 130 and may extend axially therefrom. In one implementation, spade portion 132 may have substantially planar upper and lower surfaces and may include a perpendicular bore 136 extending therethrough.

Figure 2A:
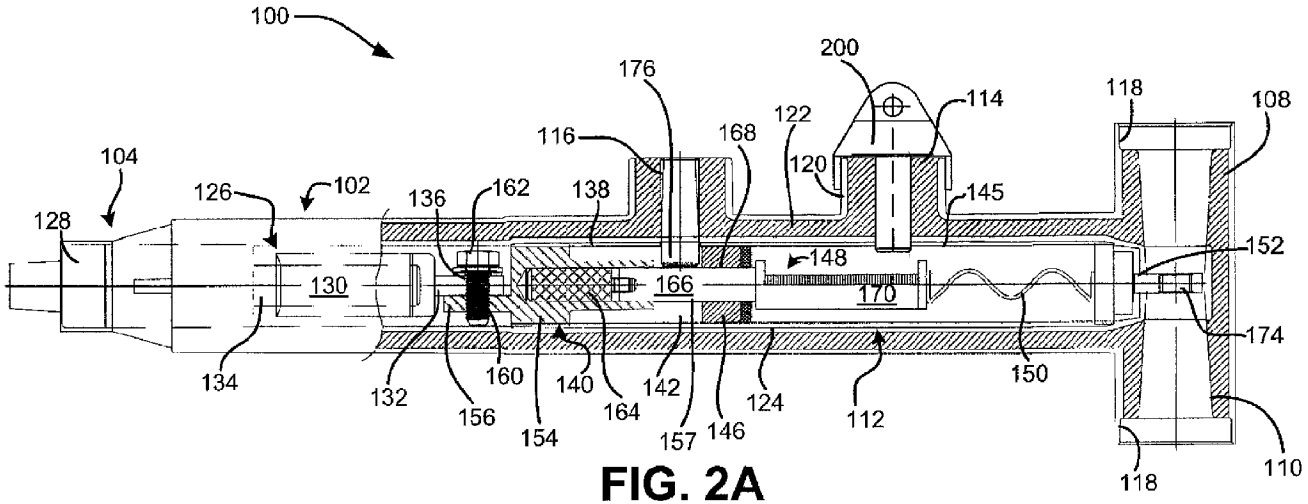
FIG. 2A is a schematic cross-sectional diagram illustrating an electrical connector consistent with implementations described herein in an energized state.
Figure 2B:
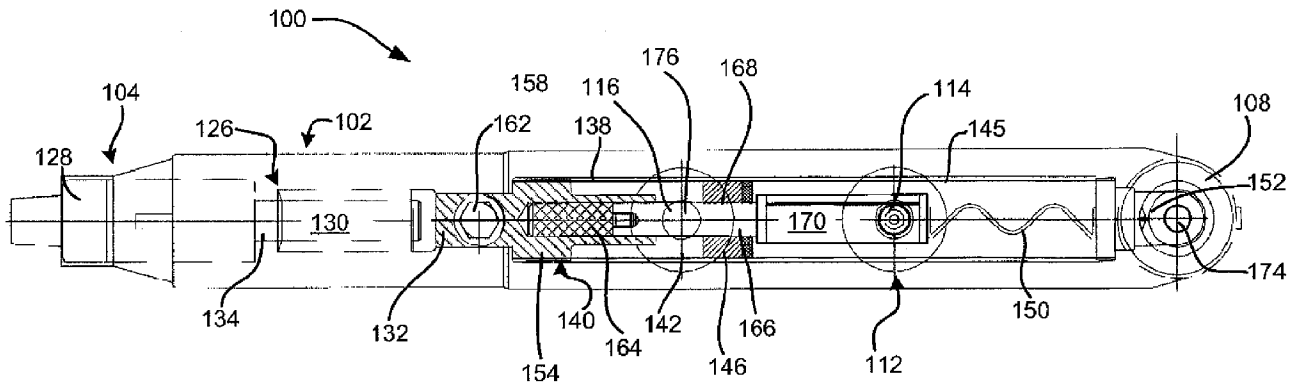
FIG. 2B is a top view diagram of the electrical connector of FIG. 2A in the energized state.

As shown in FIG. 1A, visible open linking assembly 112 may be configured to enable conductive coupling of power cable 106 to T ends 108 and 110 when the link is in an energized state (as shown in FIGS. 2A and 2B). As shown in FIGS. 1A and 1B, when visible open linking assembly 112 is in an insulated or de-energized state, visible open linking assembly 112 is configured to insulate T-ends 108 and 110 from power cable 106.

In one embodiment, visible open linking assembly 112 may include a housing 138, a rearward spade assembly 140, a cavity 142, a linking pin 144, a rack and pinion housing 145, a forward insulative portion 146, a conductive rack and pinion assembly 148, a flexible conductor 150, and a forward spade portion 152.

Housing portion 138 may be formed of, for example, insulative rubber or epoxy material and may be substantially cylindrical in one implementation. Housing portion 138 may by sized to fit within insert 122 in connector 100.

Rearward spade assembly 140 may include a conductive insert 154 maintained within housing portion 138 and a rearward spade 156. Conductive insert 154 may be formed of a conductive material, such as copper or aluminum and may be secured within a rearward portion of housing portion 138. As shown in FIG. 1A, conductive insert 154 may include a substantially cylindrical cavity 158 formed axially in a forward portion thereof. As described below, cylindrical cavity 158 is configured to receive a portion of linking pin 144 when linking pin 144 is in an energized state. In one implementation, a portion of rearward spade assembly 140 proximate to cylindrical cavity 158 may have a decreased outside diameter with respect to a rearward portion of rearward spade assembly 140. As shown in FIG. 1A, this configuration may allow cavity 142 to surround the portion of rearward spade assembly 140 proximate to cylindrical cavity 158, thereby increasing the isolation of conductive rack and pinion assembly 148 from rearward spade assembly 140 when connector 100 is in an isolated or de-energized state.

Rearward spade 156 may project axially from housing portion 138 in a rearward direction (e.g., toward power cable 106). In one implementation, spade 156 may be formed integrally with conductive insert 154 in a one-piece construction. Similar to spade portion 132 described above, rearward spade 156 may also have substantially planar upper and lower surfaces and may include a perpendicular bore 160 extending therethrough. As shown in FIG. 1A, the position of rearward spade 156 may be offset with respect to spade portion 132, thereby allowing perpendicular bore 160 in rearward spade 156 to align with perpendicular bore 136 in spade portion 132. Spade portion 132 may be securely fastened to rearward spade 156, such as via a stud or bolt 162 threaded into bores 136/160 in spade portions 132/156, respectively.

Cavity 142 may be formed around rearward spade assembly 140 and may form an air gap between conductive rearward spade assembly 140 and forward insulative portion 146. As shown in FIG. 1A, cavity 142 may extend axially forward of rearward spade assembly 140 within housing 138 such that at least a portion of cavity 142 extends past visible open port 116 in shield 120. In addition, cavity 142 may be configured to receive at least a portion of linking pin 144, when linking pin 144 extends between conductive rack and pinion assembly 148 and rearward spade assembly 140.

Linking pin 144 may include an insulative tip portion 164 and a conductive portion 166 and may be secured to rack and pinion assembly 148 at an end proximate to conductive portion 166. Linking pin 144 may through cavity 142 and into cylindrical cavity 158 in rearward spade assembly 140. Linking pin 144 may be movable between an isolated or de-energized position (shown in FIGS. 1A and 1B) an energized position (shown in FIGS. 2A and 2B). In the isolated position, insulative tip portion 164 may be positioned within cylindrical cavity 158 and cavity 142 to bridge rearward spade assembly 140 and conductive rack and pinion assembly 148, effectively isolating cable 106 from T ends 108/110.

In the energized state, linking pin 144 may be moved (e.g., drawn further into cavity 158 in rearward spade assembly 140), such that conductive portion 166 of linking pin 144 conductively couples rearward spade assembly 140 and conductive rack and pinion assembly 148. This allows for conductive linking between cable 106 and first and second T ends 108/110.

At its forward end, linking pin 144 is conductively coupled to conductive rack and pinion assembly 148 within rack and pinion housing 145. In one embodiment, rack and pinion housing 145 may be formed of a conductive or semi-conductive material and may form a cavity that substantially surrounds rack and pinion assembly 148 and allows movement of rack and pinion assembly 148 therein.

Forward insulative portion 146 may be formed between rack and pinion housing 145 and cavity 142. As shown in FIGS. 1A and 1B, forward insulative portion 146 may include a bore 168 therethrough through which at least a portion of linking pin 144 may travel.

Conductive rack and pinion assembly 148 may be coupled to a forward end of linking pin 144 and may include a rack portion 170 aligned with link access opening 114. As shown in FIG. 1A, a suitable tool (e.g., ratchet 172) may be extended through link access opening 114 and engage rack portion 170. By turning ratchet 172, rack portion 170 may be axially translated or moved forwardly or rearwardly, thereby moving connector 100 between the isolated state and the energized state. Upon completion of the translation, tool 172 may be removed and an insulating plug 200 (shown in FIG. 2A) may be installed within link access opening 114. In some implementations, flexible conductor 150 may be expand from a compressed or relaxed configuration to a taught or stretched upon transitioning from the isolated state to the energized state.

Although an external tool 172 is shown in FIG. 1A and described above, in other implementations, manipulation of rack portion 170 may be provided by an integrated engagement assembly. For example, a gear similar to the end of tool 172 may be permanently mounted within connector body portion 102 and provided with a knob or other suitable user engagement element. In still other implementations, the gear may be electrically moved via a small motor (e.g., a servo motor) mounted within body portion 102.

Flexible conductor 150 may be secured to the forward end of rack portion 170 and may conductively couple rack portion 170 to forward spade portion 152. In one implementation flexible conductor 150 may be formed of a braided conductor (e.g., copper), a bellow, etc. Similar to spade portion 132 described above, forward spade portion 152 may extend axially from rack and pinion assembly 148 in a forward direction (e.g., toward T-ends 108/110). Forward spade portion 152 may also have substantially planar upper and lower surfaces and may include a perpendicular bore 174 extending therethrough. As shown in FIG. 1A, forward spade portion 152 may project into a space between first T end 108 and second T end 110. Once forward spade assembly 152 is properly seated within connector 100, bore 174 may allow a stud or other element associated with first T end 108 to conductively engage spade assembly 152 and/or a device connected to second T end 110.

Consistent with implementations described herein, insulative body 138 in visible open linking assembly 112 may include a visible open area 176 aligned with visible open port 116 in connector 100. In one implementation, visible open area 176 and visible open port 116 formed in connector shield 120, insulative inner housing 122, and semi-conductive insert 124, may be formed of a transparent or substantially transparent insulating material, such as glass, plastic, etc. In some implementations, visible open port 116 and/or visible open area 176 may be provided in only a portion of connector 100, as shown in FIG. 1B (e.g., as a cylindrical or rectangular window or port through connector 100).

By forming visible open area 176 and visible open port 116 of a transparent material, a technician or worker may be able to visually confirm that linking pin 144 is in the isolated or de-energized state. For example, in one implementation, insulated tip portion 164 of linking pin 144 may be formed of a particular color, such as green. In such an implementation, insulated tip portion 164 may be provided in an area adjacent to visible open area 176 and visible open port 116 when the linking pin 144 is in the isolated state, as shown in FIGS. 1A and 1B. However, when the linking pin 144 is in the energized state, as shown in FIGS. 2A and 2B, insulated tip portion 164 is moved away from the viewing area or visual proximity with visible open area 176 and visible open port 116. That is, tip portion 164 is not visible via visible open port 116 when connector 100 is in the isolated state. In another embodiment, conductive portion 166 of linking pin 144 may be provided with a second color, such as red. A visible red portion 166 within visible open port 116 may indicate that connector 100 is in an energized condition.

By providing an effective and safe mechanism for visibly identifying an open break in an electrical connector without requiring removal of switchgear components, various personnel may be more easily able to safely identify and confirm an isolated or de-energized condition in a switchgear assembly. More specifically, consistent with aspects described herein, personnel may be able to physically view the isolation element, and not merely an indicator of an open status, thereby more fully ensuring the personnel that the equipment is, in fact, de-energized. Furthermore, by providing the visible open on an elbow connector connected to the switchgear, existing or legacy switchgear may be easily retrofitted and the entire system may maintain a ground connection throughout operation.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for other devices, such as other medium or high voltage switchgear equipment, such as any 15 kV, 25 kV, 35 kV, etc., equipment, including both dead-break-class and loadbreak-class equipment.

For example, various features have been mainly described above with respect to elbow power connectors. In other implementations, other medium/high voltage power components may be configured to include the visible open port configuration described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector assembly, comprising:

a connector body having a conductor receiving end, a connector end, a linking assembly connecting the conductor receiving end to the connector end, and a visible open port positioned in the connector body for viewing at least a portion of the linking assembly;

wherein the linking assembly comprises:

a rearward conductive end conductively coupled to the conductor receiving end;

a flexible conductor conductively coupled to the connector end; and a linking pin coupled to the flexible conductor and movable between a first position and a second position, wherein the first position maintains the conductor receiving end electrically isolated from the connector end, and the second position conductively couples the conductor receiving end to the connector end.

2. The electrical connector assembly of claim 1, further comprising:

a link access opening formed in the connector body proximate to the linking assembly, wherein the linking assembly further comprises a rack portion connected to the flexible conductor and the linking pin, wherein the rack portion is positioned proximate to the link access opening, such that a tool inserted via the link access opening is used to move the rack portion from a first rack position corresponding to the first position to a second rack position corresponding to the second position.

3. The electrical connector assembly of claim 1, wherein the visible open port comprises a transparent or substantially transparent material.

4. The electrical connector assembly of claim 1, wherein the connector end comprises an interface for receiving a grounding device, a plug, a bushing, a tap, or a voltage arrestor.

5. The electrical connector assembly of claim 1, wherein the connector end comprises a first connector end projecting perpendicularly from the connector body and a second connector end projecting oppositely from the first connector end.

6. The connector assembly of claim 1, wherein the connector body comprises a power cable elbow.

7. The electrical connector assembly of claim 1, wherein the linking assembly further comprises:

a cavity positioned between the rearward conductive end and the flexible conductor, wherein the cavity allowing passage of the linking pin therethrough, and wherein the visible open port is formed in an area of the connector body proximate to the cavity.

8. The electrical connector assembly of claim 7, wherein at least a portion of the linking assembly proximate to the visible open port comprises a transparent or substantially transparent material.

9. The electrical connector assembly of claim 1, wherein the rearward conductive end includes a cavity for engagingly receiving a portion of the linking pin therein;

wherein the linking pin comprises an insulated tip and a conductive portion; and wherein, when in the first position, the conductive portion of the linking pin is removed from the cavity in the rearward conductive end, such that the conductive portion of the linking pin does not contact the rearward conductive end.

10. The electrical connector assembly of claim 9, wherein, when in the second position, the conductive portion of the linking pin is received within the cavity in the rearward conductive end, such that the conductive portion contacts the rearward conductive end, thereby electrically coupling the conductor receiving to the connector end.

11. The electrical connector assembly of claim 9, wherein, when in the first position, the insulated tip of the linking pin contacts the rearward conductive end, thereby electrically isolating the connector end from the conductor receiving end.

12. The electrical connector assembly of claim 11, wherein, when in the first position, at least a portion of the insulated tip of the linking pin is visible through the visible open port.

13. The electrical connector assembly of claim 12, wherein the insulated tip is green in color.

14. A power cable elbow assembly, comprising:

a connector body having an axial bore therethrough, wherein the connector body comprises:

a conductor receiving end for receiving a cable;

a connector end projecting substantially perpendicularly from the connector body at an end distal from the conductor receiving end;

a linking assembly connecting the conductor receiving end to the connector end; and a viewing port positioned on the connector body for viewing at least a portion of the linking assembly, wherein the linking assembly comprises a linking pin moveable between a first position and a second position, wherein the first position maintains the conductor receiving end electrically isolated from the connector end, and the second position conductively couples the conductor receiving end to the connector end, and wherein the viewing port is configured to enable viewing of at least a portion of the linking pin.

15. The power cable elbow assembly of claim 14, wherein the linking assembly further comprises:

a rearward conductive portion coupled to the conductor receiving end and configured to receive the linking pin therein, wherein the linking pin comprises a insulative portion and a conductive portion, and wherein, when in the first position, the conductive portion of the linking pin is not in contact with the rearward conductive portion.

16. The power cable elbow assembly of claim 15, wherein, when in the first position, at least a portion of the insulative portion of the linking pin is viewable through the viewing port.

17. The power cable elbow assembly of claim 14, wherein the linking assembly further comprises:

a rack portion coupled to the linking pin, and a flexible conductor connecting the rack portion to the connector end, wherein the rack portion is moveable to enable movement of the linking pin between the first position and the second position.

18. The power cable elbow assembly of claim 17, further comprising a link access opening for facilitating movement of the rack portion.

* * * * *